US005819838A

United States Patent [19]

De Vylder et al.

[11] Patent Number: 5,819,838

[45] Date of Patent: Oct. 13, 1998

[54] METHOD OF MANUFACTURING A BIMETALLIC GRINDING WHEEL

[75] Inventors: Jean De Vylder, Embourg; Norbert Guerard, Esneux, both of Belgium

[73] Assignee: Magotteaux International, Vaux-Sous-Chevremont, Belgium

[21] Appl. No.: 817,853

[22] PCT Filed: Sep. 22, 1995

[86] PCT No.: PCT/EP95/03744

§ 371 Date: Apr. 17, 1997

§ 102(e) Date: Apr. 17, 1997

[87] PCT Pub. No.: WO96/12581

PCT Pub. Date: May 2, 1996

[30] Foreign Application Priority Data

Oct. 24, 1994 [LU] Luxembourg ..... 88549

[51] Int. Cl.[6] ..... B22D 19/16; B22D 27/04; B22D 13/04

[52] U.S. Cl. ..... 164/105; 164/114; 164/118

[58] Field of Search ..... 164/114, 118, 164/103, 104, 105

[56] References Cited

U.S. PATENT DOCUMENTS 4,932,460 6/1990 High ..... 164/105

FOREIGN PATENT DOCUMENTS 59-202153 11/1984 Japan ..... 164/103

*Primary Examiner*—Kuang Y. Lin
*Attorney, Agent, or Firm*—Schmeiser, Olsen & Watts

[57] ABSTRACT

The method comprises the step of arranging at the periphery of a shell (10) capable of withstanding a temperature of at least 400° C. inserts (16) of highly wear-resistant material, preheating the shell (10) and the inserts (16) in an oven, removing rapidly the shell (10) together with the inserts (16) from the oven, placing them on a centrifugal casting machine which is set in rotation, pouring ductile cast iron (18) and demoulding after cooling.

8 Claims, 1 Drawing Sheet

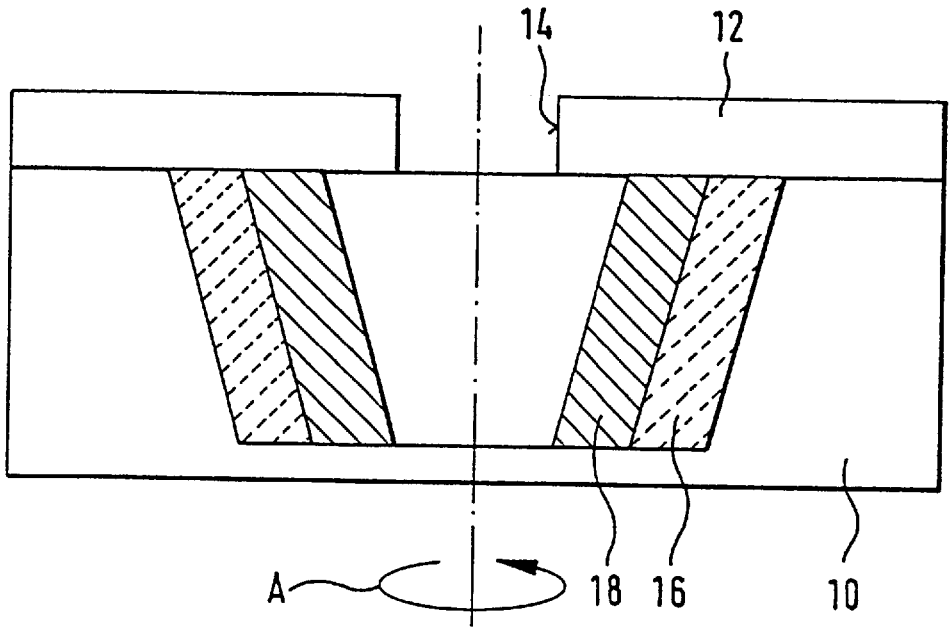
14
12
A
18
16
10

METHOD OF MANUFACTURING A BIMETALLIC GRINDING WHEEL

BACKGROUND OF THE INVENTION

The present invention relates to a method of manufacturing a bimetallic grinding wheel of generally frustoconical or cylindrical shape, comprising a cast support made of machinable ductile cast iron in the outer surface of which are embedded, longitudinally, in the direction of the generatrix, wear inserts made of a material having a high wear resistance, the said inserts being retained in the support by mechanical bonding. The invention also relates to a grinding wheel obtained by the implementation of this method.

Grinding wheels consisting of an outer wear layer which is supported by a more ductile core are known. These wheels are produced by successive casting of the wear layer and of the supporting core in order to form a metallurgical bond between the two materials. Given that this method of manufacture can be implemented only for a few pairs of compatible materials for a metallurgical bond, the choice of materials, both for the wear layer and for the supporting core, is limited. To produce the metallurgical bond furthermore requires perfect synchronization of the casting operations and good control of the casting temperature.

Document EP 0,476,496 A1 recommends the technique of using inserts for the manufacture of grinding wheels by the implementation of a method as described in the preamble.

According to this document, the inserts are cast separately in first moulds and subsequently placed in a sand mould into which the supporting core is poured in order to form a mechanical bond between the two materials. Contrary to the metallurgical bond, the mechanical bond does not involve constraints from the choice-of-materials standpoint, so that it is possible to choose harder alloys for the inserts, for example high-alloy chromium cast irons or any other highly wear-resistant material, and more suitable alloys for the core, such as spheroidal graphite cast iron.

This technique also enables the casting capacity to be doubled, given that the inserts are cast separately and may be stored for the purpose of the second casting.

However, this technique often comes up against other difficulties. When the second casting is carried out into the sand mould on cold inserts, these run the risk of cracking induced by heat shock. In order to avoid this risk, or at least to reduce it, it is necessary to preheat the inserts to a temperature of the order of 400° to 500° C. Now, this preheating is not easy to perform given that it must entail bringing bulky heating equipment close to the sand mould and, in addition, the necessary temperature to be reached generally causes the binder used for the mould sand to be destroyed.

It is also necessary to fix the inserts temporarily in the sand mould in order to prevent them from moving during casting. For this purpose, a destructible temporary support may be provided or, they may be simply wedged against each other in order to jam them by a vault effect.

SUMMARY OF THE INVENTION

The object of the present invention is to provide a novel method of manufacturing bimetallic grinding wheels which enables the drawbacks associated with the known method to be eliminated or at least reduced, while still keeping their advantages.

In order to achieve this objective, the invention provides a method of the kind described in the preamble, which is characterized in that a mould is used which consists of a transportable shell made of metal or any other material capable of withstanding a temperature of at least 400° C., in that the inserts are stood up at the periphery of the shell, in that the shell and the inserts are preheated in an oven, in that the shell together with the inserts are rapidly removed from the oven and placed on a centrifugal casting machine which is set in rotation, in that the ductile cast iron is poured and in that demoulding takes place after cooling.

The ductile cast iron is preferably a lamellar or nodular grey cast iron, while the inserts are preferably made of chromium cast iron or a highly wear-resistant material.

Before installing the inserts in the shell, it is provided with a thin refractory coating.

The oven may be preheated to a temperature of the order of 100° to 500° C.

The centrifugal casting machine is rotationally driven at a speed of the order of 100 to 600 revolutions per minute.

The wheel may be demoulded when the temperature has fallen to a value of the order of 500° C.

This method makes it possible to keep all the advantages obtained with the insert technique, especially those which are due to the presence of the mechanical bond between the inserts. Furthermore, the use of a transportable shell as a mould eliminates the problems of preheating the inserts, given that this preheating may now be carried out in an oven in which the shell is placed together with the inserts installed beforehand. This also enables the preheating temperature to be controlled better.

Casting using centrifuging provides, moreover, an effect of natural complementarity, beneficial to the insert technology. The centrifugal force generated by the rotation of the shell automatically locks the inserts against the wall of the shell and thus contributes to better fixing of the inserts and to a reduction in the risk of movement during casting. Furthermore, under the effect of the centrifugal force, the cast iron completely fills the spaces between the inserts in order to clamp them perfectly, without the risk of forming cavities due to the solidification of the cast iron before all the interstices are filled.

BRIEF DESCRIPTION OF THE DRAWING

Other features and characteristics of the invention will emerge from the detailed description of an advantageous embodiment, presented below, by way of illustration, with reference to the appended figure which illustrates an axial section through a mould before a wheel produced according to the present invention is demoulded.

DETAILED DESCRIPTION OF THE PREFERRED EMBODIMENTS

The mould shown in the figure is in the form of a transportable shell 10, the volume of which corresponds to a grinding wheel, in this case an axisymmetrical truncated cone. The shell 10 includes a closure lid 12 with a central pouring hole 14.

The first step consists in coating the inside of the shell with a thin refractory layer in order to protect the shell and to make the moulding easier. Next, inserts 16, cast beforehand in another mould, not shown, are arranged in the shell. These inserts 16 may be made of any wear-resistant material (eg. carbides, ceramics, etc.) or chromium cast iron, of the kind described in document EP 0 476 496, in which case they may be wedged against each other and jammed by a vault effect.

Next, the shell 10, together with the inserts 16, is placed in an oven preheated to a temperature of 100° to 500° C., depending on the nature of the materials used, so as to heat up the inserts to a temperature sufficient to prevent heat shock.

When the inserts are at the desired temperature, the shell 10 is rapidly removed from the oven and placed on the rotary platform of a centrifugal casting machine known per se. This machine is driven at a speed which may vary between 100 and 600 revolutions per minute in order to rotate the shell, together with the inserts, about its vertical axis (arrow A). During the rotation of the shell 10, the supporting material for the wheel, for example lamellar or nodular grey cast iron, is poured through the pouring hole 14. Under the effect of the centrifugal force, the cast iron spreads out in the form of a frustoconical layer over the inserts 16 and fills all the interstices between them. After this casting, the assembly is allowed to cool and demoulding takes place at a temperature of the order of 500° C. The wheel thus produced includes an axial frustoconical bore enabling it to be fixed, by shrink-fitting, to a support hub after a finishing machining operation.

We claim:

1. Method of manufacturing a bimetallic grinding wheel of generally frustoconical or cylindrical shape, comprising a cast support made of machinable ductile cast iron in the outer surface of which are embedded, longitudinally, in the direction of the generatrix, wear inserts made of a highly wear-resistant material, the said inserts being retained in the support by a mechanical bond, the method comprising the steps of:

providing a transportable shell (10) made of a material capable of withstanding a temperature of at least 400° C.;

installing the inserts (16) at the periphery of the shell (10);

preheating the shell (10) in an oven;

rapidly removing the shell (10) from the oven, and placing the shell (10) on a centrifugal casting machine;

rotating the centrifugal casting machine to rotate the shell (10);

pouring ductile cast iron (18) into the rotating shell (10) to form the bimetallic grinding wheel; and demoulding the bimetallic grinding wheel after cooling.

2. Method according to claim 1, characterized in that the ductile cast iron is a lamellar grey cast iron.

3. Method according to claim 1, characterized in that the inserts are made of high-alloy chromium cast iron.

4. Method according to claim 1, characterized in the further step of:

providing the shell with a thin refractory coating before the inserts (16) are installed.

5. Method according to claim 1, characterized in that the shell and the inserts are preheated in the oven at a temperature of the order of 100° to 500° C.

6. Method according to claim 1, characterized in that the centrifugal casting machine is rotated at a speed of the order of 100 to 600 revolutions per minute.

7. Method according to claim 1, characterized in that demoulding takes place at a temperature of the order of 500° C.

8. Method according to claim 1, characterized in that the ductile cast iron is a nodular grey cast iron.

* * * * *